US009240676B2

(12) United States Patent
Katsuraya

(10) Patent No.: US 9,240,676 B2
(45) Date of Patent: Jan. 19, 2016

(54) IGNITION PLUG

(71) Applicant: NGK SPARK PLUG CO., LTD., Nagoya-shi, Aichi (JP)

(72) Inventor: Kohei Katsuraya, Nagoya (JP)

(73) Assignee: NGK SPARK PLUG CO., LTD., Aichi (JP)

( * ) Notice: Subject to any disclaimer, the term of this patent is extended or adjusted under 35 U.S.C. 154(b) by 0 days.

(21) Appl. No.: 14/650,592

(22) PCT Filed: Oct. 2, 2013

(86) PCT No.: PCT/JP2013/076769

§ 371 (c)(1),
(2) Date: Jun. 9, 2015

(87) PCT Pub. No.: WO2014/097708

PCT Pub. Date: Jun. 26, 2014

(65) Prior Publication Data

US 2015/0333487 A1 Nov. 19, 2015

(30) Foreign Application Priority Data

Dec. 17, 2012 (JP) ..... 2012-274217

(51) Int. Cl.
*H01T 13/20* (2006.01)
*H01T 13/08* (2006.01)

(52) U.S. Cl.
CPC ..... *H01T 13/20* (2013.01); *H01T 13/08* (2013.01)

(58) Field of Classification Search
CPC ..... H01T 13/20; H01T 21/02
USPC ..... 313/142, 141
See application file for complete search history.

(56) References Cited

U.S. PATENT DOCUMENTS

| | | | | |
|---|---|---|---|---|
| 2006/0028108 | A1 | 2/2006 | Okabe et al. | 313/143 |
| 2010/0314987 | A1 | 12/2010 | Kyuno et al. | 313/130 |

FOREIGN PATENT DOCUMENTS

| | | | | |
|---|---|---|---|---|
| JP | 61-290679 | | 12/1986 | H01T 13/20 |
| JP | 63-202874 | | 8/1988 | H01T 13/20 |
| JP | 2000-243535 | | 9/2000 | H01T 13/20 |
| JP | 2006-049207 | A | 2/2006 | H01T 13/20 |
| WO | WO 2009/069798 | A1 | 6/2009 | H01T 13/20 |

OTHER PUBLICATIONS

Search Report issued in corresponding International Patent Application No. PCT/JP2013/076769, dated Dec. 3, 2013.

*Primary Examiner* — Vip Patel

(74) *Attorney, Agent, or Firm* — Kusner & Jaffe

(57) ABSTRACT

A spark plug has a metal shell and a cylindrical ceramic insulator disposed in an inner circumference of the metal shell. An axial hole extends in an axial line CL direction through the insulator, and has a tip located more to a tip side of the spark plug than a tip of the metal shell, and a distance along the axial line CL1 from the tip of the metal shell to the tip of the ceramic insulator is 0.5 mm or more. The insulator satisfies C ≥1.07 mm and V ≤3.9 $mm^3$, where C is a thickness of the insulator in a cross section passing an inner circumference surface tip of the metal shell and orthogonal to the axial line CL1 ,and V is a volume of the ceramic insulator within a range of 0.5 mm from the tip of the ceramic insulator to a rear end side in the axial line CL1 direction.

11 Claims, 5 Drawing Sheets

IGNITION PLUG

RELATED APPLICATIONS

This application is a National Stage of International Application No. PCT/JP13/76769 filed Oct. 2, 2013, which claims the benefit of Japanese Patent Application No. 2012-274217, filed Dec. 17, 2012.

FIELD OF THE INVENTION

The present invention relates to an ignition plug (hereinafter also called as a spark plug) used in an internal combustion engine and the like.

BACKGROUND OF THE INVENTION

A spark plug is installed to an internal combustion engine (engine) and the like and used for igniting the air-fuel mixture and the like inside a combustion chamber. In general, the spark plug includes an insulator having an axial hole extending along the axial direction, a center electrode inserted in the tip side of the axial hole, a metal shell provided to the outer circumference of the insulator, and a ground electrode fixed to the tip portion of the metal shell. Further, a gap is formed between the tip portion of the ground electrode and the tip portion of the center electrode, and the ignition to the air-fuel mixture and the like is made by applying a high voltage to the center electrode (gap) to generate a spark discharge.

Further, in recent years, high compression and high supercharging engines have been proposed for the improved fuel economy and the like. In such engine, the in-cylinder pressure is relatively high, which requires a higher voltage (discharge voltage) for generating the spark discharge (for example, 37 kV or more). Therefore, when the voltage for generating the spark discharge is applied to the center electrode, a discharge penetrating the insulator between the center electrode and the metal shell (a penetration discharge) is likely to occur and thus there is a likelihood that the spark discharge cannot be properly generated.

Therefore, in order to improve the dielectric strength of the insulator, an approach has been proposed wherein the thickness of the tip portion of the insulator is increased, i.e., is formed relatively thick and where the spark penetration is particularly likely to occur (see JP-A-2000-243535, for example).

When the tip of the insulator is thickened, however, a large thermal shock occurs at the tip portion of the insulator at a heating and cooling, which is likely to cause a breakage of the insulator. In particular, in a direct injection engine where the fuel is directly injected to the tip portion of the insulator, breakage of the insulator due to the thermal shock is of greater concerned, because the insulator is rapidly cooled by the fuel.

The present invention is made taking the above situation into consideration and its purpose is to provide a spark plug that is able to effectively suppress the breakage of the insulator due to the thermal shock while further ensuring the prevention of the spark penetration in the insulator.

Below, each configuration suitable to solve the above-described problem will be described by listing items. It is noted that the effect and advantage specific to the corresponding configuration will be additionally described, if necessary.

SUMMARY OF THE INVENTION

Configuration 1

In accordance with a first aspect of the present invention, there is provided a spark plug that includes: a cylindrical metal shell; and a cylindrical insulator disposed in an inner circumference of the metal shell, having an axial hole extending in an axial direction, and has a tip located more to a tip side than a tip of the metal shell, a distance along the axial line from the tip of the metal shell to the tip of the insulator is 0.5 mm or more, and $C \geq 1.07$ mm and $V \leq 3.9$ mm$^3$ are satisfied, where C is a thickness of the insulator in a cross section that passes a tip of an inner circumference surface of the metal shell and that is orthogonal to the axial line, and V is a volume of the insulator within a range of 0.5 mm from the tip of the insulator to a rear end side in the axial direction.

According to configuration 1, the thickness C of the part of the insulator facing the tip of the inner circumference surface of the metal shell is 1.07 mm or more along the direction orthogonal to the axial line. That is, in the part of the insulator which faces the part of high electric field intensity and where the penetration discharge is particularly likely to occur, a sufficient thickness is secured. Therefore, a good dielectric strength performance can be obtained, which can ensure the prevention of the spark penetration in the insulator.

In addition, according to the above-described configuration 1, the volume V of the insulator within the range of 0.5 mm from the tip of the insulator to the rear end side in the axial direction (that is, the part of the insulator which is heated to a high temperature and rapidly cooled, in particular, and where the breakage due to the thermal shock is likely to occur) is 3.9 mm$^3$ or less. Here, because the thermal shock is caused by the stress due to the difference in the thermal expansion amount between the outer surface side and the inside of the insulator at the heating and cooling, the volume V of 3.9 mm$^3$ or less allows for the significant reduction of the stress. As a result, the breakage of the insulator due to the thermal shock can be effectively suppressed.

Configuration 2

In accordance with a second aspect of the present invention, there is provided a spark plug as described in the above-described configuration 1, wherein the thickness along the direction orthogonal to the axial line of the insulator is 0.9 mm or less within the range.

The configuration 2 allows for the further reduction of the stress at the heating and cooling. Thereby, the breakage of the insulator due to the thermal shock can be significantly effectively suppressed.

Configuration 3

In accordance with a third aspect of the present invention, there is provided a spark plug as described in the above-described configuration 1 or 2, wherein a gap formed between the outer circumference surface of the center electrode and the inner circumference surface of the insulator in the range is defined as a first gap, a gap formed between the outer circumference surface of the center electrode and the inner circumference surface of the insulator in the cross section is defined as a second gap, and at least a part of the first gap is larger than the second gap.

According to the above-described configuration 3, the range is provided with the first gap that is a relatively large gap formed between the outer circumference surface of the center electrode and the inner circumference surface of the insulator. Therefore, the inner circumference surface of the insulator can be distant from the outer circumference surface of the center electrode, which allows for the suppression of the rapid cooling of the inner circumference side of the insulator due to the removal of the heat from the center electrode. As a result, the stress can be further reduced, and the thermal shock resistance in the insulator can be further enhanced.

Configuration 4

In accordance with a fourth aspect of the present invention, there is provided a spark plug as described in any one of the above-described configurations 1 to 3, wherein of the outer circumference surface of the insulator, a outer line in the cross section including the axial line on the surface located in more tip side than the tip of the metal shell has a curve whose tangent passes the tip portion of the insulator.

It is noted that "a curve whose tangent passes the tip portion of the insulator" refers to the curve that is convex toward the axial line side, the oblique tip side, and the oblique rear end side.

According to the above-described configuration 4, the tip portion of the insulator is formed so as to be concave toward its inner circumference side. This makes it easier to have the volume V of 3.9 $mm^3$ or less, which can further ensure the effect and advantage (the advantage of suppressing the breakage of the insulator due to the thermal shock) of the above-described configuration 1 and the like.

Further, the configuration 4 allows for the increased surface area in the tip portion of the insulator. As a result, this can further ensure the prevention of the abnormal discharge running on the surface of the insulator between the center electrode and the metal shell and the ignition stability can be enhanced.

Configuration 5

In accordance with a fifth aspect of the present invention, there is provided a spark plug as described in any of the above-described configurations 1 to 4, wherein the metal shell has a thread portion for installation, and the thread size of the thread portion is M12 or less.

In recent years, in order to reduce the size of the spark plug (reduce the diameter), the metal shell may be reduced in the diameter and the insulator disposed in the inner circumference of the metal shell may also be reduced in diameter, resulting in the insulator with a thinned thickness. In such insulator with the thinned thickness, the dielectric strength performance is relatively low, and thus the penetration discharge is more likely to occur.

In this regard, as seen in the above-described configuration 5, in a spark plug in which the thread size of the thread portion is M12 or less, although there is a concern of the occurrence of the penetration discharge, the occurrence of the penetration discharge can be more surely prevented by employing the above-described configuration 1 and the like and setting the thickness C to 1.07 mm or more. In other words, the above-described configuration 1 and the like is effective to the spark plug in which the thread size of the thread portion is M12 or less and the penetration discharge is likely to occur.

DETAILED DESCRIPTION OF THE PREFERRED EMBODIMENTS

Figure 1:
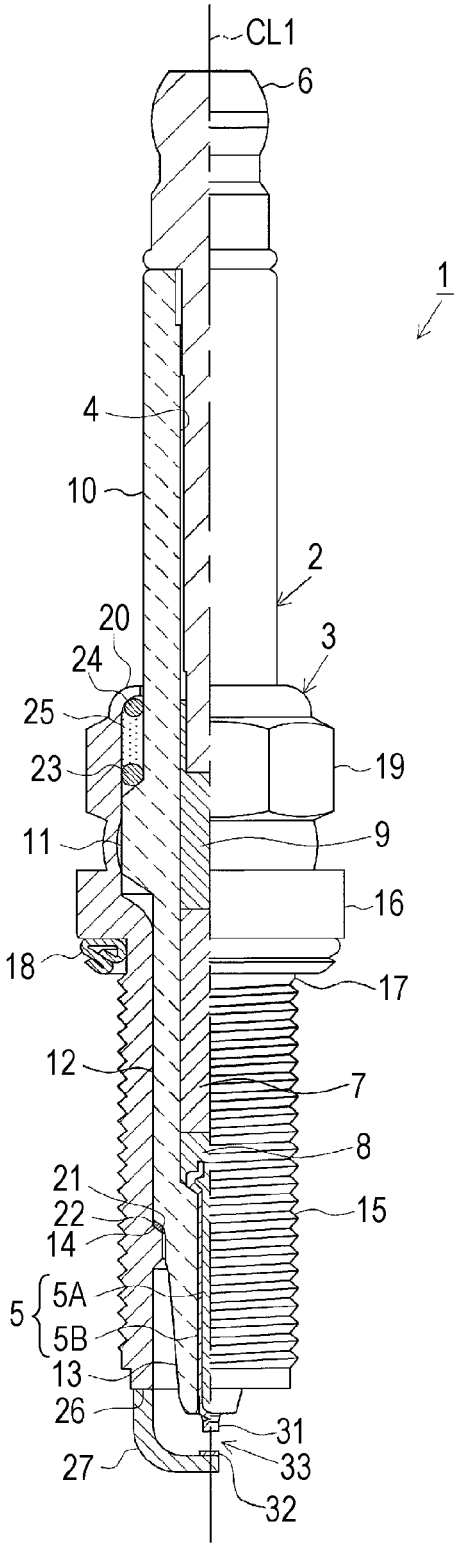
FIG. 1 is a partial sectional front view illustrating a configuration of a spark plug.

One embodiment will be described below by referring to the drawings. FIG. 1 is a partial sectional front view illustrating a spark plug 1. It is noted that, in FIG. 1, the description will be provided with the definition that the direction of an axial line CL1 of the spark plug 1 is the upper-lower direction in the drawing, the lower side is the tip side of the spark plug 1, and the upper side is the rear end side.

The spark plug 1 is configured with a ceramic insulator 2 as a cylindrical insulator, a cylindrical metal shell 3 holding it, and the like.

The ceramic insulator 2 is formed by sintering alumina and the like as well known, and has a rear end side body portion 10 formed in the rear end side, a large-diameter portion 11 protruded outward in the radial direction in more tip side than the rear end side body portion 10, a middle body portion 12 formed in a thinner diameter than the large-diameter portion 11 in the tip side, and an insulator nose portion 13 formed in a thinner diameter than the middle body portion 12 in the tip side. Further, a taper step portion 14 is formed in a connection between the middle body portion 12 and the insulator nose portion 13, and the ceramic insulator 2 is locked in the metal shell 3 at the step portion 14.

Figure 2:
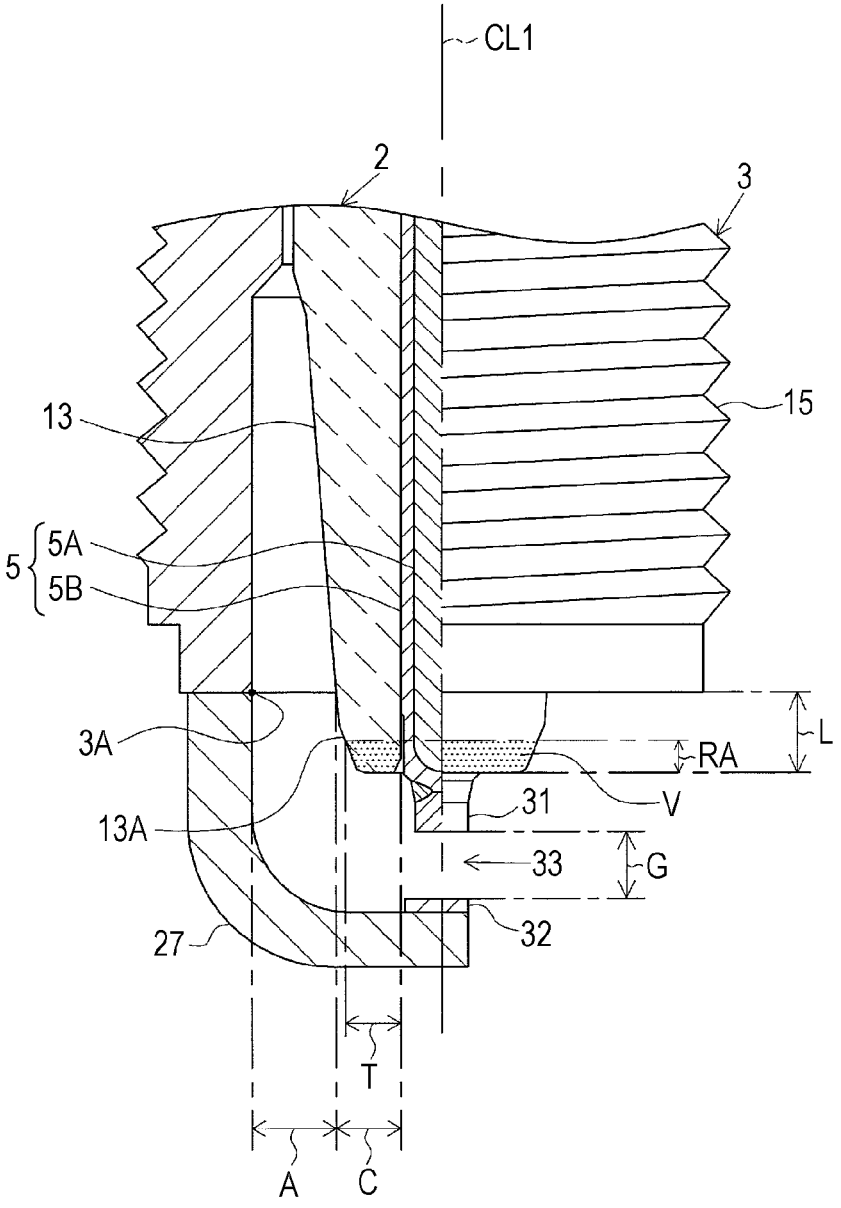
FIG. 2 is an enlarged partial sectional front view illustrating a configuration of a tip portion of the spark plug.

In addition, the large-diameter portion 11, the middle body portion 12, and most part of the insulator nose portion 13 of the ceramic insulator 2 is accommodated in the metal shell 3. On the other hand, the tip of the ceramic insulator 2 is located more to the tip side than the tip of the metal shell 3 and, as illustrated in FIG. 2, the distance L along the axial line CL1 from the tip of the metal shell 3 to the tip of the ceramic insulator 2 is 0.5 mm or more.

Turning back to FIG. 1, an axial hole 4 formed to penetrate the ceramic insulator 2 along the axial line CL1, and a center electrode 5 is inserted in the tip side of the axial hole 4. The center electrode 5 has an inner layer 5A made of a metal (for example, copper, copper alloy, pure nickel (Ni)) and the like that is superior in the thermal conductivity and an outer layer 5B made of an alloy whose main component is Ni. Further, the center electrode 5 is generally bar-like (column) and projects out of the tip end of the ceramic insulator 2. Further, to the tip end of the center electrode 5, joined is a column-shaped center electrode side tip 31 made of a metal that is superior in the high wear resistance (for example, iridium (Ir), platinum (Pt), rhodium (Rh), ruthenium (Ru), rhenium (Re), tungsten (W), palladium (Pd), or an alloy having at least one of them as a main component).

Further, in the rear end side of the axial hole 4, a terminal electrode 6 is inserted and fixed projecting out of the rear end of the ceramic insulator 2.

Further, a column resistor 7 is disposed between the center electrode 5 and the terminal electrode 6 in the axial hole 4. Both ends of the resistor 7 are electrically connected to the center electrode 5 and the terminal electrode 6 via conductive glass seal layers 8 and 9, respectively.

In addition, the metal shell 3 is formed in a cylindrical shape from a metal such as a low carbon steel, and a thread portion (terminal stud portion) 15, for installing the spark plug 1 to the installation hole of the internal combustion engine and the like, is formed on its outer circumference surface. Further, a flange-shaped seating portion 16 is formed in more rear side than the thread portion 15. A ring-shaped gasket 18 is fitted in a thread root 17 of the rear end of the thread portion 15. Furthermore, the rear end side of the metal shell 3 is provided with a tool engaging portion 19 whose cross section is shaped in a hexagon for engaging a tool such as a wrench therein when the metal shell 3 is installed to the internal combustion engine. A crimping portion 20 is provided for holding the ceramic insulator 2 at the rear end. It is noted that, in the present embodiment, the metal shell 3 is reduced in diameter in order to reduce the size (reduce the diameter) of the spark plug 1 and the thread size of the thread portion 15 is M12 or less.

Further, a tapered step portion 21 for locking the ceramic insulator 2 is provided on the inner circumference surface of the metal shell 3. Then, the ceramic insulator 2 is inserted from the rear end side to the tip end side with respect to the metal shell 3. and the insulator 2 is fixed when the rear end side opening of the metal shell 3 is crimped inward in the radial direction with its step portion 14 being locked to the step portion 21 of the metal shell 3, that is, insulator 2 is fixed when the above-described crimping portion 20 is formed. It is noted that an annular plate packing 22 is interposed between the step portions 14 and 21. This allows the airtightness in the combustion chamber to be maintained, so that there is no leakage, to the outside, of the fuel gas entering the gap between the insulator nose portion 13 of the ceramic insulator 2 and the inner circumference surface of the metal shell 3 that is exposed in the combustion chamber.

Furthermore, in order to ensure more complete closure by crimping, annular ring members 23 and 24 are interposed between the metal shell 3 and the ceramic insulator 2 at the rear end side of the metal shell 3, and the powder of talc 25 is filled between the ring members 23 and 24. That is, the metal shell 3 holds the ceramic insulator 2 via the plate packing 22, the ring members 23 and 24, and the talc 25.

Further, a bar-shaped ground electrode 27 whose side surface in the tip side faces the tip portion of the center electrode 5 is joined to a tip portion 26 of the metal shell 3. Ground electrode 27 is bent at its middle part. Furthermore, a column-shaped ground electrode side tip 32 made of a metal that is superior in the high wear resistance (for example, Ir, Pt, Rh, Ru, Re, W, Pd, or an alloy whose main component is at least one of them) is joined to the part of the ground electrode 27 facing the tip surface of the center electrode 5 (a center electrode side tip 31). Further, a gap 33 is formed between the tip portion of the center electrode 5 (the center electrode side tip 31) and the tip end of the ground electrode 27 (the ground electrode side tip 32), and the application of the voltage to the gap 33 can cause the spark discharge to generate.

Furthermore, as illustrated in FIG. 2, the present embodiment is configured to satisfy $C \geq 1.07$ mm, where C represents the thickness of the ceramic insulator 2 in the cross section that passes the inner circumference surface tip 3A of the metal shell 3 and that is orthogonal to the axial line CL1.

It is noted that the insulator nose portion 13 has a part whose outer diameter is constant and a part whose outer diameter decreases toward the tip side in the axial line CL1 only. The part of the ceramic insulator 2 more to the rear end side than the measured object portion with the thickness C has a larger thickness than the thickness C.

Further, the present embodiment is configured to satisfy $G<A$, where A (mm) represents the distance along the direction orthogonal to the axial line CL1 from the inner circumference surface tip 3A of the metal shell 3 to the outer circumference surface of the ceramic insulator 2 and G (mm) represents the size of the gap 33, in order to prevent the abnormal discharge (so called side spark and/or flashover) running on the surface of the ceramic insulator 2 between the center electrode 5 and the metal shell 3. That is, in the present embodiment, while the thickness C is sufficiently large, the distance A from the measured object portion with the thickness C of the ceramic insulator 2 to the inner circumference surface tip 3A of the metal shell 3 is large enough to be larger than the size G of the gap 33.

Furthermore, in the present embodiment, of the insulator nose portion 13, namely, the part 13A projecting out of the tip of the metal shell 3 has an inclination angle (more specifically, the angle of the acute angle of the angles between the outer line of that part and the line parallel to the axial line, in the cross section including the axial line CL1) that is larger than an inclination angle in the part of the insulator nose portion 13 that is more to the rear end side than the part 13A. This results in that $V \leq 3.9$ mm$^3$ is satisfied, where V represents the volume of the ceramic insulator 2 within the range (the part hatched with dots in FIG. 2) RA of 0.5 mm from the tip of the ceramic insulator 2 toward the rear end side in the axial line CL1 direction.

Further, within the range RA, the thickness (the maximum thickness) T along the direction orthogonal to the axial line CL1 of the ceramic insulator 2 is 0.9 mm or less.

As has been described in detail, according to the present embodiment, the part of the ceramic insulator 2 that faces the inner circumference surface tip 3A of the metal shell 3 (the part where the electric field intensity is high), and where the penetration discharge is particularly likely to occur, has the thickness C of 1.07 mm or more. This allows the good dielectric strength performance to be obtained, which can further ensure the prevention of the spark penetration in the ceramic insulator 2.

In particular, in the present embodiment, while the thread size of the thread portion 15 is M12 or less and thus there is a concern of the occurrence of the penetration discharge, the thickness C being 1.07 mm or more can further ensure the prevention of the penetration discharge.

In addition, the volume V of the ceramic insulator 2 within the range RA is 3.9 mm$^3$ or less, which allows for the sufficient reduction of the stress due to the difference in the thermal expansion amount between the outer surface and the inside of the ceramic insulator 2. As a result, the breakage of the ceramic insulator 2 due to the thermal shock can be effectively suppressed.

Further, the thickness T is 0.9 mm or less, which allows for the further reduction of the stress. Thereby, the breakage of the ceramic insulator 2 due to the thermal shock can be further effectively suppressed.

Next, in order to confirm the effect and advantage resulted from the above-described embodiment, samples of the spark plug in which the thickness C (mm) of the ceramic insulator was different in various ways were fabricated and a test for evaluating the dielectric strength performance was done for each sample. The outline of the test for evaluating the dielectric strength performance is as follows. That is, the sample was installed to a direct injection T/C engine with the displacement of 1.6 L and repeated for 50 cycles, where one cycle is defined that the engine is operated with the throttle opening being 50% to the full. It is noted that the maximum voltage of approximately 45 kV was applied to the center electrode under the above operation condition of the engine. Then, after the 50 cycles, it was confirmed whether or not spark penetration occurred due to the application of the voltage to the ceramic insulator. Here, the samples in which the spark penetration of the ceramic insulator was confirmed were evaluated as "Poor," representing the samples had insufficient dielectric strength performance. Samples in which no spark penetration in the ceramic insulator was confirmed were evaluated as "Good," representing the samples having the superior dielectric strength performance. Table 1 indicates the result of the test.

TABLE 1

| No. | Thickness C (mm) | Evaluation |
|---|---|---|
| 1 | 0.87 | Poor |
| 2 | 0.92 | Poor |
| 3 | 0.97 | Poor |
| 4 | 1.02 | Poor |
| 5 | 1.07 | Good |
| 6 | 1.12 | Good |
| 7 | 1.17 | Good |

As indicated in Table 1, it was confirmed that the samples with a thickness C of 1.07 mm or more (samples 5 to 7) have a superior dielectric strength performance. It is estimated that this is because the sufficient thickness is secured in the part of the ceramic insulator which faces the tip of the inner circumference surface of the metal shell (the part whose electric field intensity is high) and where the penetration discharge is particularly likely to occur.

Next, samples of the spark plug in which the volume V ($mm^3$) was different in various ways were fabricated and a test for evaluating the thermal shock resistance was done for each sample.

The outline of the test for evaluating the thermal shock resistance is as follows.

The sample was installed to a predetermined water cooling chamber. The tip portion of the sample (including the tip portion of the ceramic insulator) was heated so that the tip portion of the center electrode reached 850° C. by a predetermined burner. Immediately after the heating by the burner was stopped, water was injected to the tip portion of the sample by a predetermined spray valve.

In such a way, a sample was tested for 20 cycles, where a heating and rapid cooling of the tip portion of the sample (the tip portion of the ceramic insulator) is defined as one cycle, and it was determined whether or not the breakage occurred in the tip portion of the ceramic insulator after the 20 cycles.

Here, the samples in which the breakage of the tip portion of the ceramic insulator was confirmed were evaluated as "Poor," representing that the samples had inferior thermal shock resistance. Samples in which no breakage of the tip portion of the ceramic insulator was confirmed were evaluated as "Good," representing that the samples had superior thermal shock resistance. Table 2 indicates the result of the test.

TABLE 2

| No. | Volume V ($mm^3$) | Evaluation |
|---|---|---|
| 11 | 1.96 | Good |
| 12 | 3.26 | Good |
| 13 | 3.54 | Good |
| 14 | 3.56 | Good |
| 15 | 3.77 | Good |
| 16 | 3.84 | Good |
| 17 | 3.90 | Good |
| 18 | 4.14 | Poor |
| 19 | 4.44 | Poor |
| 20 | 4.76 | Poor |
| 21 | 5.08 | Poor |

As indicated in Table 2, it was clear that the samples whose volume V is 3.9 $mm^3$ or less (samples 11 to 17) have a good shock resistance. This is because, while the stress occurs due to the difference in the thermal expansion between the outer surface side and the inside of the ceramic insulator, the volume V being 3.9 $mm^3$ or less results in the sufficiently reduced stress.

From the results of both tests described above, it is determined to be preferable for the ceramic insulator to satisfy $C \geq 1.07$ mm and $V \leq 3.9$ $mm^3$ in terms of ensuring the good thermal shock resistance while preventing the spark penetration.

Next, samples of the spark plug were fabricated wherein the thickness (the maximum thickness) T (mm) along the direction orthogonal to the axial line of the ceramic insulator within the range of 0.5 mm from the tip of the ceramic insulator to the rear end side in the axial direction was different with the volume V being substantially the same. The above-described test for evaluating the thermal shock resistance was then done for each sample. It is noted that, in the present test, the heating and rapid cooling of the tip portion of the sample (tip portion of the ceramic insulator) was repeated for 50 cycles. The samples in which no breakage of the tip portion of the ceramic insulator was confirmed were evaluated as "Excellent," representing that the samples had extremely superior thermal shock resistance. Table 3 indicates the result of the test.

TABLE 3

| No. | Volume V ($mm^3$) | Thickness T (mm) | Evaluation |
|---|---|---|---|
| 31 | 3.84 | 0.97 | Good |
| 32 | 3.87 | 0.90 | Excellent |

As indicated in Table 3, the sample whose thickness T is 0.9 mm or less (sample 32) has the extremely superior thermal shock resistance. It is estimated that this is because the thickness T being 0.9 mm or less results in that the stress due to the difference in the thermal expansion amount between the outer surface side and the inside of the ceramic insulator is significantly reduced.

As a result of the test described above, it is preferable that the thickness T, along the direction orthogonal to the axial line of the ceramic insulator within the range of 0.5 mm from the tip of the ceramic insulator to the rear end side of the axial line, is 0.9 mm or less.

It is noted that the implementation is not limited to the disclosure of the above-described embodiment and may be implemented as follows, for example. Of course, other applications or modifications than will be exemplified below are reasonably possible.

Figure 3:
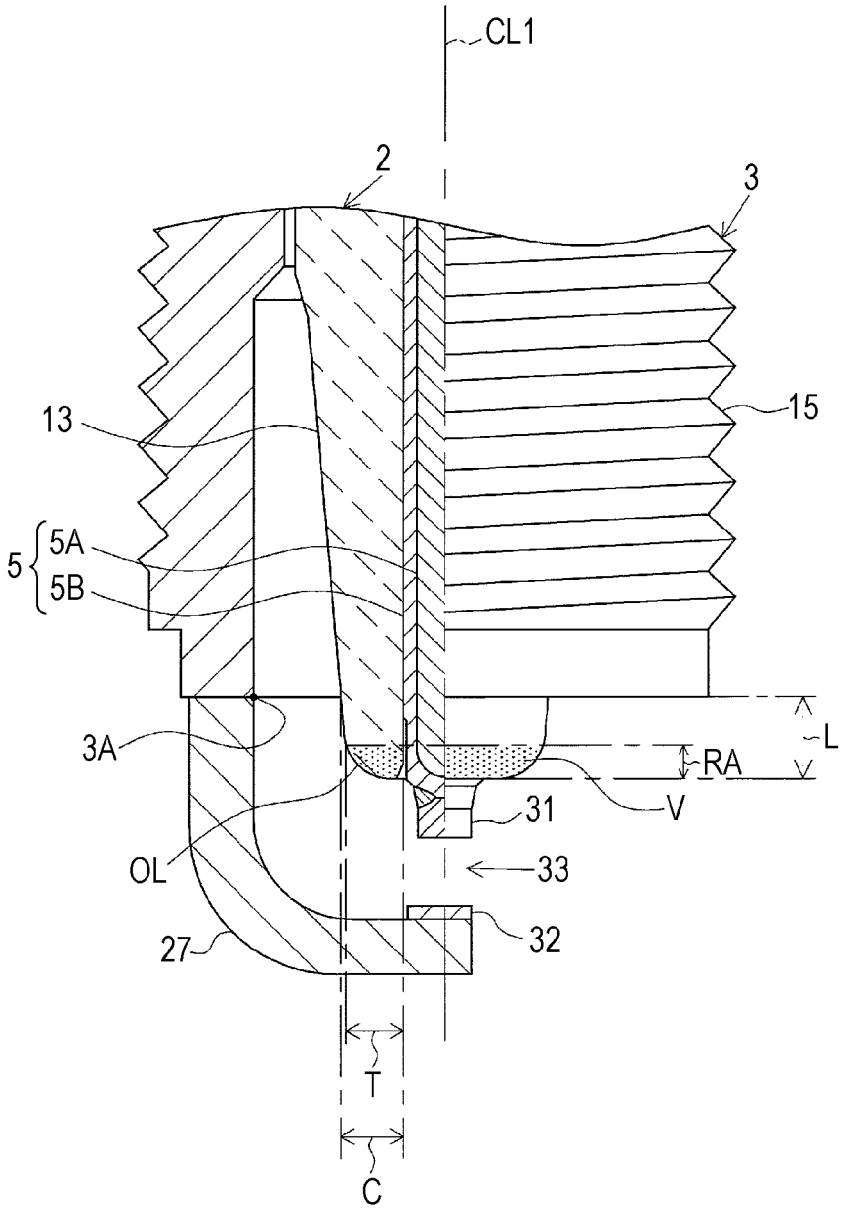
FIG. 3 is a partial sectional front view illustrating a configuration of a tip of a spark plug of another embodiment.

(a) In the above-described embodiment, in order to satisfy $V \leq 3.9$ $mm^3$, the inclination angle of the part 13A of the insulator nose portion 13, that projects out of the tip of the metal shell 3 is larger than the inclination angle of the part in more rear end side than the part 13A of the insulator nose portion 13. In contrast, as illustrated in FIG. 3, it may be configured to satisfy $V \leq 3.9$ $mm^3$ by having a relatively larger radius of curvature of the outer line OL in the cross section including the axial line CL1 of the surface located more to the tip side than the tip of the metal shell 3 of the outer circumference surface of the ceramic insulator 2.

Figure 4A:
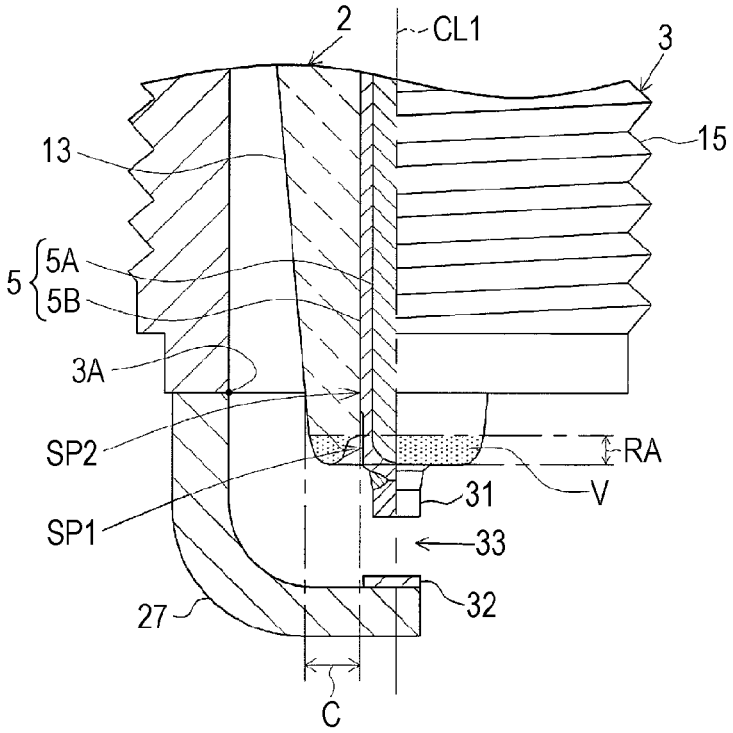
FIG. 4A and FIG. 4B are partial sectional front views illustrating a configuration of a tip portion of a spark plug in another embodiment.
Figure 4B:
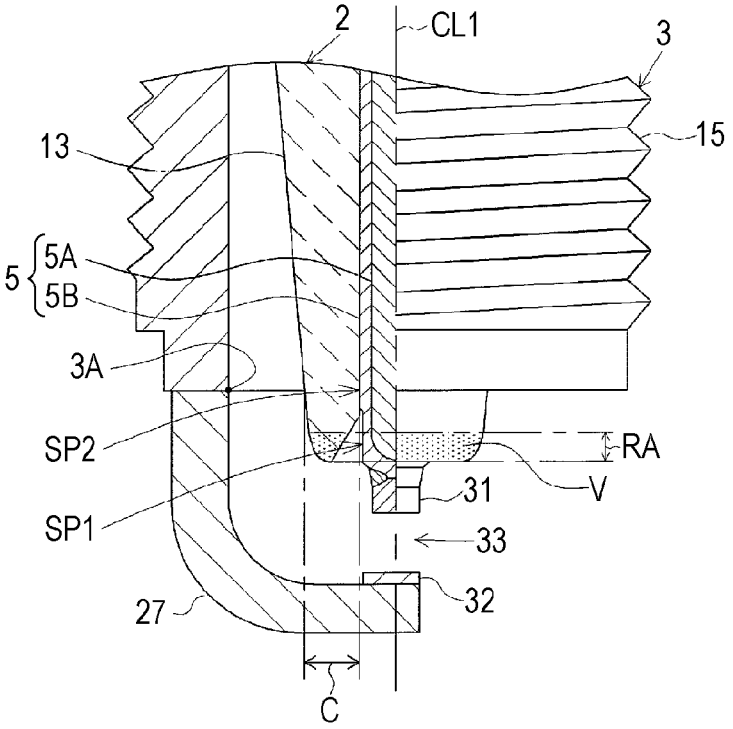

(b) While the tip portion of the axial hole 4 is configured so as to have substantially a constant inner diameter in the above-described embodiment, it may be configured such that the diameter of the tip of the axial hole 4 is relatively large and therefore a first gap SP1 is formed between the outer circumference surface of the center electrode 5 and the inner circumference surface of the ceramic insulator 2 within the range RA, and at least a part of the first gap SP1 is larger than a second gap SP2 (a gap formed between the outer circumference surface of the center electrode 5 and the inner circumference surface of the ceramic insulator 2 in the cross section that passes the inner circumference surface tip 3A of the metal shell 3 and that is orthogonal to the axial line CL1). This case makes it easier to have the volume V of 3.9 $mm^3$ or less. Further, the inner circumference surface of the ceramic insulator 2 can be distant from the outer circumference surface of the center electrode 5 in the range where the first gap SP1 is located, which allows for the suppression of the rapid cooling of the inner circumference surface of the ceramic insulator 2 due to the removal of the heat from the center electrode 5, as illustrated in FIG. 4A and FIG. 4B. As a result, the stress can be further reduced and the thermal shock resistance in the ceramic insulator 2 can be further enhanced.

It is noted that, in order to ensure the improvement of the thermal shock resistance in the ceramic insulator 2, it is preferable that the maximum value of the first gap SP1 (the distance along the direction orthogonal to the axial line CL1 from the tip of the inner circumference surface of the ceramic insulator 2 to the outer circumference surface of the center electrode 5 in FIG. 4) is 0.25 mm or more. Further, the first gap may be formed by reducing the outer diameter of the tip portion of the center electrode 5.

Figure 5A:
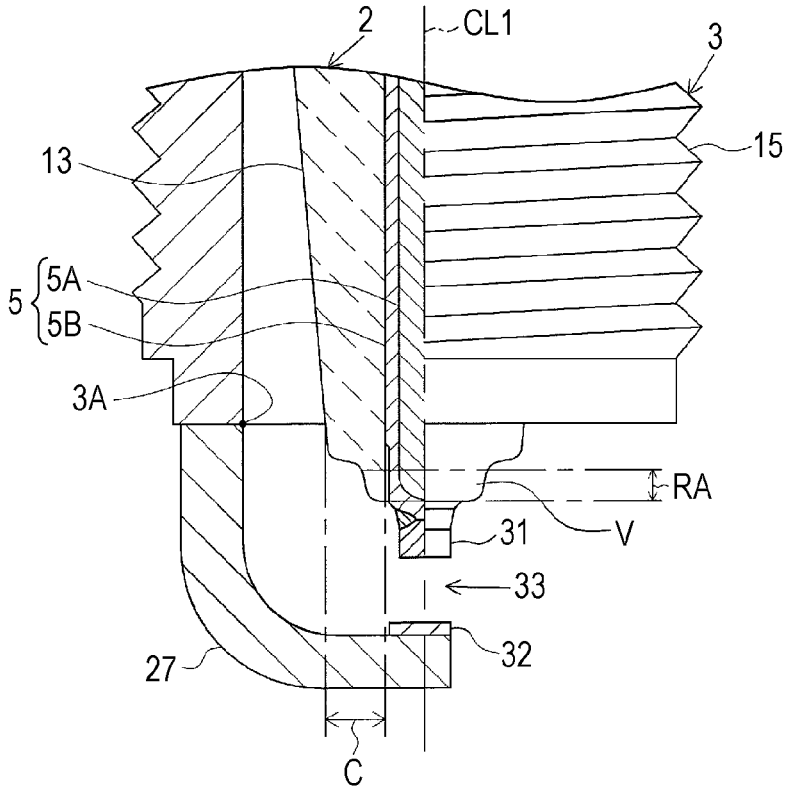
FIG. 5A is a partial sectional front view illustrating a configuration of a tip portion of a spark plug in another embodiment.
Figure 5B:
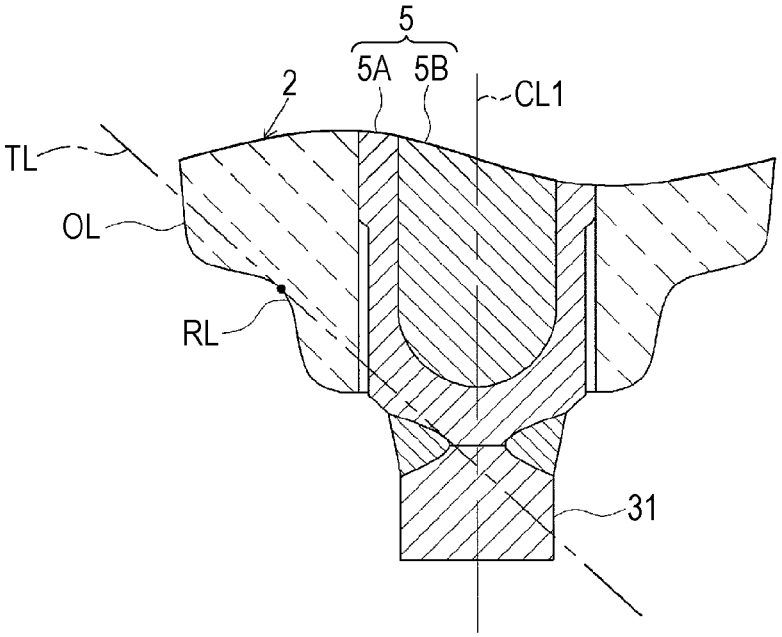
FIG. 5B is an enlarged sectional view illustrating an outer line and the like in a tip portion of a ceramic insulator.

(c) It may be configured to satisfy $V \leq 3.9$ $mm^3$ by that the outer diameter of the tip portion of the ceramic insulator 2 is relatively small as illustrated in FIG. 5A. Further, in this case, as illustrated in FIG. 5B, a curve RL whose tangent TL passes the tip of the ceramic insulator 2 lies in the outer line OL in the cross section including the axial line CL1 of the surface of the outer circumference surface of the ceramic insulator 2 located more to the tip side than the tip portion of the metal shell 3. This configuration allows for the increased surface area in the tip portion of the ceramic insulator 2, which can ensure the prevention of the occurrence of the abnormal discharge running on the surface of the ceramic insulator 2 between the center electrode 5 and the metal shell 3.

(d) Although the center electrode side tip 31 and the ground electrode side tip 32 are provided in the above-described embodiment, at least one of them may be omitted.

(e) Although the spark plug 1 in the above-described embodiment ignites the air-fuel mixture and the like by generating the spark discharge at the gap 33, the spark plug to which the technical concept of the present invention is applicable is not limited to the above. Therefore, the technical concept of the present invention may be applied to a plasma spark plug that supplies an alternating current to the gap to generate plasma at the gap and ignites the air-fuel mixture and the like by the generated plasma.

(f) Although the thread size of the thread portion 15 of the spark plug 1 is M12 or less in the above-described embodiment, the technical concept of the present invention may be applied to the spark plug in which the thread size of the thread portion 15 is larger than M12.

(g) Although the case that the ground electrode 27 is joined to the tip portion 26 of the metal shell 3 is embodied in the above-described embodiment, it may be applicable to the case that a part of the metal shell (or a part of the tip metal portion welded in advance to the metal shell) is cut out to form the ground electrode (for example, JP-A-2006-236906).

(h) Although the tool engaging portion 19 is shaped in a hexagon in the cross section in the above-described embodiment, the shape of the tool engaging portion 19 is not limited to such shape. For example, it may be formed in a Bi-HEX (modified twelve-sided polygon) shape (ISO22977:2005(E)) and the like.

DESCRIPTION OF REFERENCE SIGNS

1 Spark plug
2 insulator
3 Metal shell
3A Inner circumference surface tip (of the metal shell)
4 Axial hole
5 Center electrode
15 Thread portion
CL1 Axial line
OL Outer line (of the ceramic insulator)
RL Curve
SP1 First gap
SP2 Second gap
TL Tangent

The invention claimed is:

1. A spark plug comprising:

a cylindrical metal shell; and a cylindrical insulator disposed in an inner circumference of the metal shell, having an axial hole extending in an axial direction, and having a tip located more to a tip side of the spark plug than a tip of the metal shell, wherein a distance along the axial line from the tip of the metal shell to the tip of the insulator is 0.5 mm or more, and wherein $C \geq 1.07$ mm and $V \leq 3.9$ $mm^3$ are satisfied, where C is a thickness of the insulator in a cross section that passes a tip of an inner circumference surface of the metal shell and that is orthogonal to the axial line, and V is a volume of the insulator within a range of 0.5 mm from the tip of the insulator to a rear end side in the axial direction.

2. The spark plug according to claim 1, wherein, in the range, a thickness along a direction orthogonal to the axial line of the insulator is 0.9 mm or less.

3. The spark plug according to claim 1, further comprising a center electrode inserted in the axial hole, wherein a gap formed between an outer circumference surface of the center electrode and an inner circumference surface of the insulator in the range is defined as a first gap, a gap formed between an outer circumference surface of the center electrode and an inner circumference surface of the insulator in the cross section is defined as a second gap, and at least a part of the first gap is larger than the second gap.

4. The spark plug according to claim 1, wherein an outer line in a cross section including the axial line on a surface located more to the tip side than the tip of the metal shell of the outer circumference surface of the insulator has a curve whose tangent passes the tip of the insulator.

5. The spark plug according to claim 1, wherein the metal shell has a thread portion for installation, and a thread size of the thread portion is M12 or less.

6. The spark plug according to claim 2, further comprising a center electrode inserted in the axial hole, wherein a gap formed between an outer circumference surface of the center electrode and an inner circumference surface of the insulator in the range is defined as a first gap, a gap formed between an outer circumference surface of the center electrode and an inner circumference surface of the insulator in the cross section is defined as a second gap, and at least a part of the first gap is larger than the second gap.

7. The spark plug according to claim 2, wherein an outer line in a cross section including the axial line on a surface located more to the tip side than the tip of the metal shell of the outer circumference surface of the insulator has a curve whose tangent passes the tip of the insulator.

8. The spark plug according to claim 3, wherein an outer line in a cross section including the axial line on a surface located more to the tip side than the tip of the metal shell of the outer circumference surface of the insulator has a curve whose tangent passes the tip of the insulator.

9. The spark plug according to claim 2, wherein the metal shell has a thread portion for installation, and a thread size of the thread portion is M12 or less.

10. The spark plug according to claim 3, wherein the metal shell has a thread portion for installation, and a thread size of the thread portion is M12 or less.

11. The spark plug according to claim 4, wherein the metal shell has a thread portion for installation, and a thread size of the thread portion is M12 or less.

* * * * *